United States Patent [19]

Araki

[11] 4,307,819

[45] Dec. 29, 1981

[54] BOX COMPRISING MAIN PORTION AND LID PORTION PIVOTABLY CONNECTED TO MAIN PORTION

[76] Inventor: Yukio Araki, 14-16, Okino-1, Adachi-Ku, Tokyo, Japan

[21] Appl. No.: 235,772

[22] Filed: Feb. 19, 1981

[30] Foreign Application Priority Data

| | | | |
|---|---|---|---|
| Feb. 28, 1980 | [JP] | Japan | 55-25488[U] |
| Sep. 10, 1980 | [JP] | Japan | 55-127890[U] |
| Oct. 4, 1980 | [JP] | Japan | 55-142182[U] |
| Oct. 4, 1980 | [JP] | Japan | 55-142183[U] |

[51] Int. Cl.[3] ..... B65D 43/14; B65D 51/04

[52] U.S. Cl. ..... 220/341; 220/338

[58] Field of Search ..... 220/334, 338, 341; 16/128

[56] References Cited

U.S. PATENT DOCUMENTS

| | | | |
|---|---|---|---|
| 2,734,222 | 2/1956 | Kiba | 220/338 |
| 3,023,923 | 3/1962 | Geib et al. | 220/338 |

FOREIGN PATENT DOCUMENTS

| | | | |
|---|---|---|---|
| 481871 | 1/1917 | France | 220/338 |
| 1525348 | 4/1967 | France | 220/338 |

*Primary Examiner*—George T. Hall

*Attorney, Agent, or Firm*—Lawrence I. Field

[57] ABSTRACT

A box such as a pencil case comprises a main portion having a bottom wall and a side wall and made of a thin metal plate, a lid portion having a top wall and a side wall and made of a thin metal plate, and a hinge member for pivotably connecting the lid portion to the main portion along an axial line laying in the side walls. The hinge member comprises first and second recesses formed in a lower edge of the side wall of lid portion and extending in the axial line, first and second shafts formed at the lower edge of the side wall of lid portion and extending in parallel with the first and second recesses, respectively, and first and second grooves formed in the side wall of main portion, the first and second shafts being rotatably inserted into the first and second grooves, respectively.

14 Claims, 14 Drawing Figures

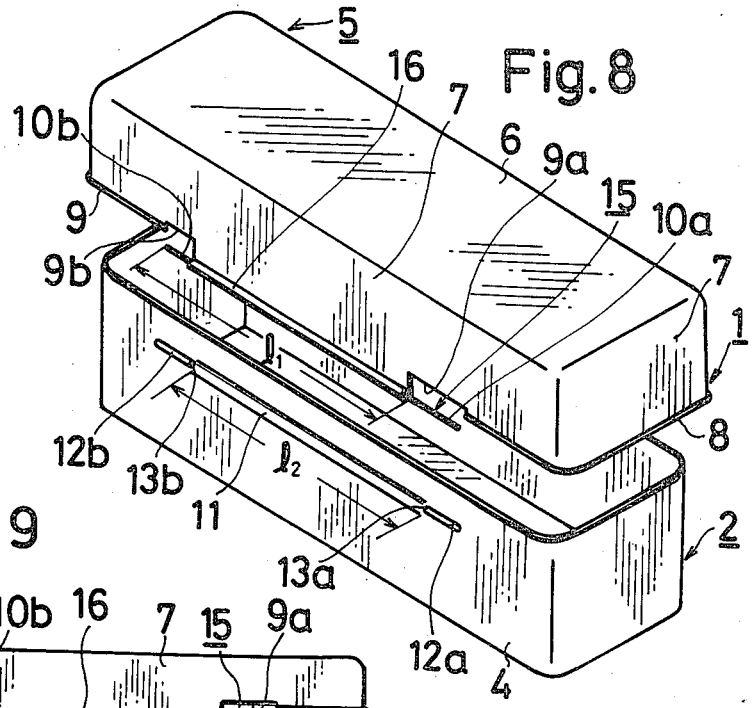
Fig. 8
Fig. 9
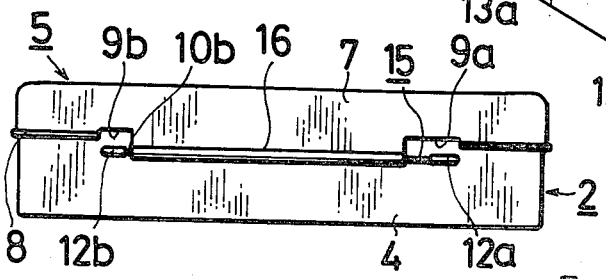
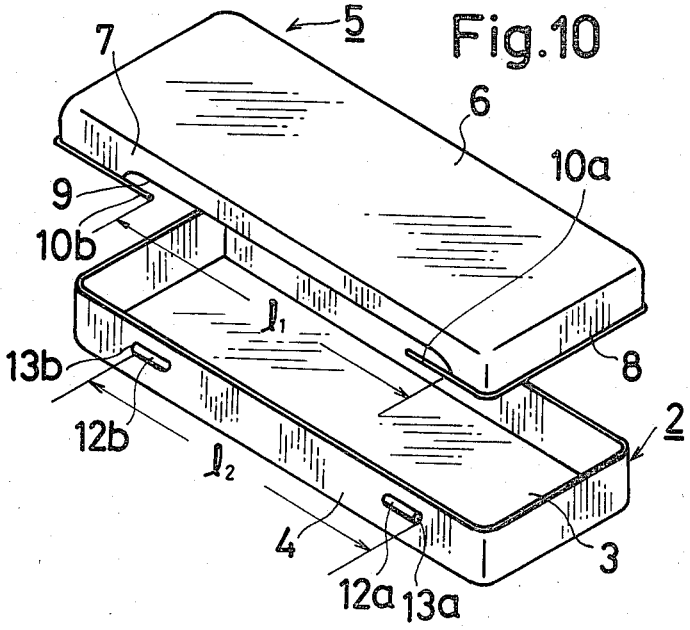
Fig. 10

BOX COMPRISING MAIN PORTION AND LID PORTION PIVOTABLY CONNECTED TO MAIN PORTION

BACKGROUND OF THE INVENTION

The present invention relates to a box such as a pencile case comprising a main portion having a bottom wall and a side wall, a lid portion having a top wall and a side wall and a hinge member for pivotably connecting the lid portion to the main portion along an axial direction laying in the side walls.

For instance, a pencile case usually comprising at least three parts, i.e. a main portion made of a metal plate, a lid portion also made of a metal plate and one or two pins for coupling the lid portion with the main portion in a pivotable manner. Due to the usage of one or two pins the number of manufacturing steps is liable to increase and the manufacturing cost is expensive. Further the pin or pins have to be inserted into a groove or grooves formed at a lower edge of lid portion from the inside of the side wall of the main portion after the lid portion is placed at a position relative to the main portion and this operation is quite combersome. Moreover articles such as penciles could not be put in the main portion before the lid portion is connected to the main portion by means of the pin or pins. Therefore, the articles have to be filled in the main portion after the lid portion is coupled with the main portion. This results in that an automatically filling apparatus could be hardly utilized, because the filled articles prevent the pin or pins from being inserted in the groove or grooves.

SUMMARY OF THE INVENTION

The present invention has for its object to provide a box which can be composed of the minimum number of parts and can be manufactured simply without the necessity of inserting the pin from the inside of box, so that articles can be filled in the box before connecting the lid portion to the main portion.

A box according to the invention comprises a main portion having a bottom wall and a side wall;

- a lid portion having a top wall and a side wall, these portions being pivotably connected to each other about an axial direction which lays in the corresponding side walls of these portions;
- at least one recess formed in the side wall of lid portion and extending in said axial direction;
- first and second shafts provided at a lower edge of the side wall of lid portion and extending along said recess, a length of the first shaft being longer than that of the second shaft; and
- first and second grooves formed in the side wall of main portion and being aligned in the axial direction, a distance between the first and second grooves being slightly different from a distance between a base of the first shaft and a top of the second shaft; whereby the first shaft is first fully inserted into the first recess by relatively moving the main and lid portions in one direction in the axial direction and then these portions are relatively moved in the other direction so as to insert the second shaft into the second groove.

In the box of the present invention since the lid portion can be connected to the main portion from the outside, the article can be put in the main portion before coupling them with each other and thus, automatic filling apparatuses can be used effectively.

BRIEF DESCRIPTION OF THE DRAWINGS

FIG. 8 is an exploded perspective view illustrating another embodiment of the box according to the invention;

FIG. 9 is a rear view of the assembled box shown in FIG. 8;

FIG. 10 is an exploded perspective view showing still another embodiment of the box according to the invention;

DESCRIPTION OF THE PREFERRED EMBODIMENTS

Figure 1:
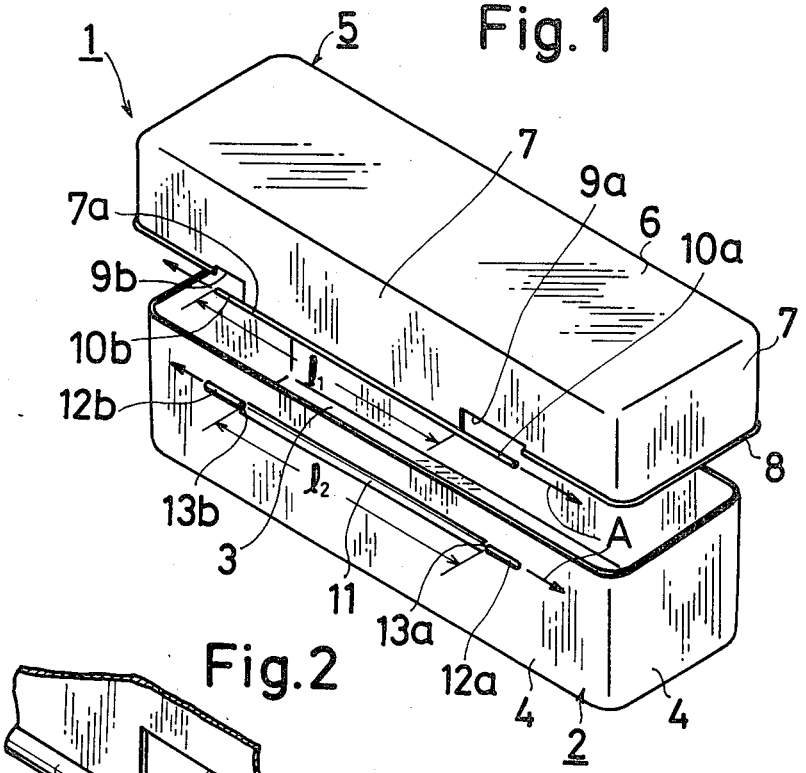
FIG. 1 is an exploded perspective view showing a first embodiment of the box according to the invention.
Figure 2:
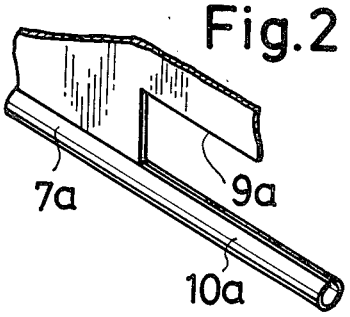
FIG. 2 is a perspective view of a part of a lid portion of the box shown in FIG. 1.

FIG. 1 is an exploded perspective view showing a first embodiment of the box according to the invention. The box 1 comprises a main portion 2 having a bottom wall 3 and a side wall 4, a lid portion 5 including a top wall 6 and a side wall 7, and a hinge member for pivotably connecting these portions 2 and 5 about an axial direction A laying in the side walls 4 and 7. Each of the main and lid portions 2 and 5 may be formed by pressing a relatively thin metal plate. In order to reinforce the lid portion 5, a lower edge of its side wall 7 is circularly turned over. In the side wall 7 in which the lid portion 5 is pivotably coupled with the main portion 2 there are formed first and second recesses **9*a* and 9*b* which extend in the axial direction A. That portion 7*a* of the side wall 7 which situates between the recesses 9*a* and 9*b* slightly descends lower than the other portion of the edge 8 of the side wall 7 and is turned over circularly. At the lower edge 7*a* there are formed first and second shafts 10*a* and 10*b*. As shown in FIG. 2 the shaft 10*a* is integrally formed with the side wall edge 7*a* by circularly turning over the wall edge. The shafts 10*a* and 10*b* extend in parallel with the recesses 9*a* and 9*b*, respectively. A length of the first shaft 10*a* is made much longer than that of the second shaft 10*b***.

In the side wall 4 of the main portion 2 there is formed a semicircular depression 11 extending in the axial direction A. At both ends of the depression 11 are formed first and second grooves **12*a* and 12*b*. The depression 11 and grooves 12*a* and 12*b* can be simply formed by cutting and pressing. A distance $l_1$ between a base of the first shaft 10*a* and a free end of the second shaft 10*b* is made slightly shorter than a distance $l_2$ between openings 13***a* and 13*b* of the grooves 12*a* and 12*b*.

Figure 3:
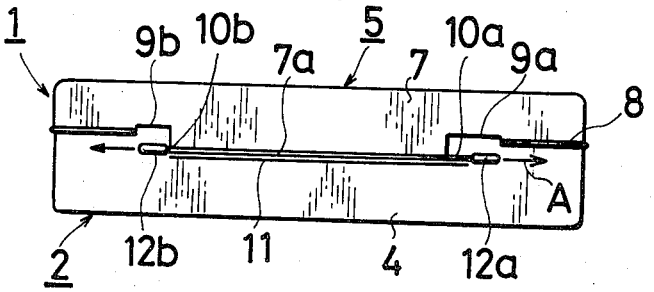
FIG. 3 is a rear view showing the composed box of FIG. 1.

In case of assembling the main portion 2 and the lid portion 5, at first the shafts 10*a* and 10*b* are aligned with the grooves 12*a* and 12*b* in the axial direction A. Then the first shaft 10*a* is inserted into the first groove 12*a* by moving the lid portion 5 with respect to the main portion 2 in one direction in the axial direction A until the base of the shaft 10*a* is made in contact with the opening 13*a* of the groove 12*a*. Since the length $l_1$ is slightly shorter than the length $l_2$, there is a small space between the free end of the second shaft 10*b* and the opening 13*b* of the second groove 12*b*. Then the second shaft 10*b* is inserted into the second groove 12*b* by moving the lid portion 5 in the other direction in the axial direction A until a base of the second shaft 10*b* hits against the opening 13*b* of the second groove 12*b*. Since the length of the first shaft 10*a* is sufficiently longer than the length of the second shaft 10*b*, the first shaft 10*a* is still remained in the first groove 12*a*. In this manner the lid portion 5 can be coupled pivotably with the main portion 2 from the outside of the main portion 2. FIG. 3 is a rear view showing the box 1 thus assembled. In the present embodiment since the edge portion 7*a* of the side wall 7 of lid portion 5 is slightly projected downwards, the first and second shafts 10*a* and 10*b* can be easily inserted into the first and second grooves 12*a* and 12*b*, respectively without being obstructed by the other edge 8 of the side wall 7.

The present invention is not limited to the above explained embodiment, but many modifications can be conceived. In the following embodiments the same portions as those of the previous embodiment will be denoted by the same reference numerals as those used in FIGS. 1 to 3.

Figure 4:
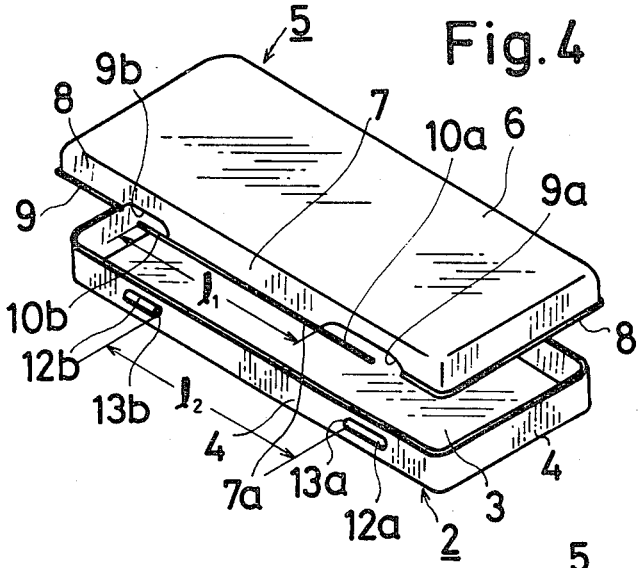
FIG. 4 is an exploded perspective view illustrating a second embodiment of the box according to the invention.
Figure 5:
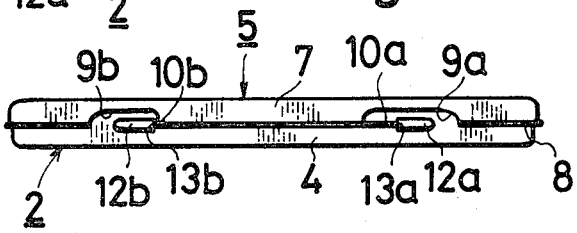
FIG. 5 is a rear view of the assembled box of FIG. 4.

FIGS. 4 and 5 are an exploded perspective view and a rear view, respectively illustrating a second embodiment of the box according to the invention. In this embodiment the first and second shafts 9*a* and 9*b* are formed substantially at a same level of the lower edge 8 of the side wall 7. Further in the side wall 4 of main portion 2 there are only formed first and second grooves 12*a* and 12*b*, but any depression is not formed.

Figure 6:
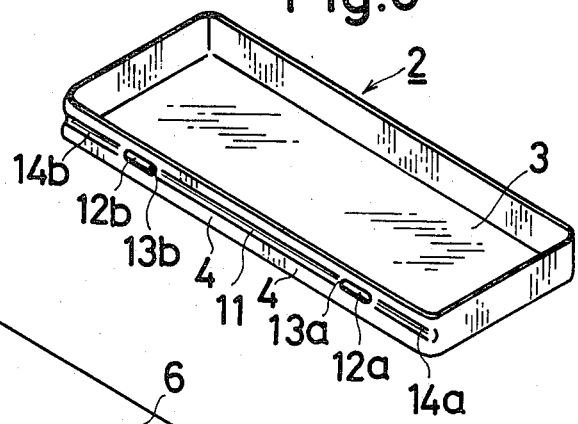
FIG. 6 is a perspective view depicting another embodiment of the main portion.

FIG. 6 is a perspective view illustrating another embodiment of the main portion 2. In this embodiment a semicircular depression 11 is formed on the side wall 4 between the first and second grooves 12*a* and 12*b*. Further similar semicircular depressions 14*a* and 14*b* are formed in the side wall 4 with being aligned with the depression 11. In this embodiment since the depressions 11, 14*a* and 14*b* are formed in the side wall 4 of the main portion 2 the first and second shafts 10*a* and 10*b* of the lid portion 5 can be smoothly inserted into the first and second grooves 12*a* and 12*b*. Further the lid portion 5 can be smoothly rotated about the shafts 10*a* and 10*b*.

Figure 7:
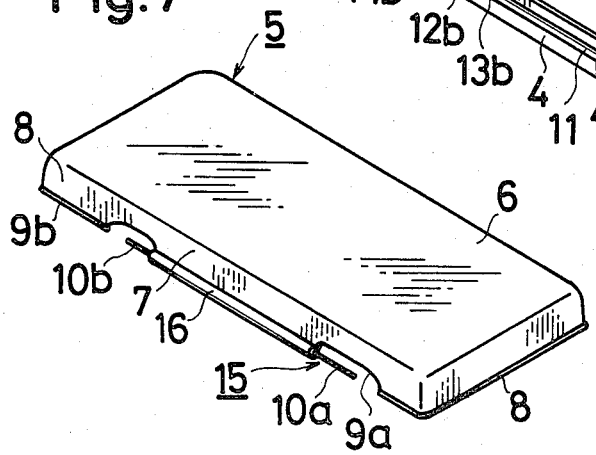
FIG. 7 is a perspective view showing another embodiment of the lid portion.

FIG. 7 is a perspective view depicting another embodiment of the lid portion 5. In this embodiment the first and second shafts 10*a* and 10*b* are formed by both end portions of a single pin 15 which is inserted in a groove 16 formed at the lower edge of the side wall 7. In order to fix the pin 15 at a given position, the pin 15 is clamped inside the groove 16. Since the outer diameter of the groove 16 should be somewhat larger than that of the curled lower edge 7*a* of the previous embodiments, it is necessary to form the depression 11 in the side wall 4 of main portion 2. In this embodiment even if the pin 15 is used, it can be secured to the lid portion 5 before assembling the lid and main portions, so that articles such as penciles can be filled in the main portion 2 before assembling. In modifications of this embodiment the first and second shafts 10*a* and 10*b* may be formed by separate pins of short length. Moreover the pin or pins may be secured to the lower edge of the side wall 7 of lid portion 5 by welding or cementing.

FIGS. 8 and 9 show a third embodiment of the box according to the invention. This embodiment substantially corresponds to a combination of the previous embodiments illustrated in FIGS. 1 and 4. That is to say in the present embodiment the portion of the side wall 7 between the first and second recesses 9*a* and 9*b* descends below the periphery 8 of the other portion of the side wall 7 and the pin 15 is inserted into the groove 16 formed by turning over the lower edge of the descended portion of side wall 7. In this embodiment it is sufficient to form the depression 11 in the side wall 4 of main portion 2 between the first and second grooves 12*a* and 12*b*.

Figure 11:
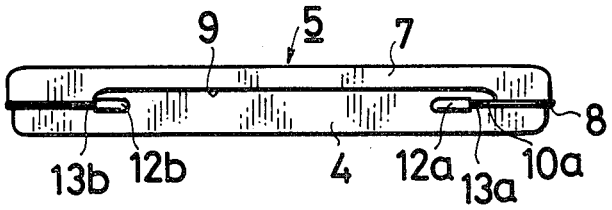
FIG. 11 is a rear view of the composed box of FIG. 10.

FIGS. 10 and 11 illustrate a fourth embodiment of the box according to the invention. In the present embodiment a single elongated recess 9 is formed in the lower edge of the side wall 7 of lid portion 5 and the first and second shafts 10*a* and 10*b* are formed along the recess 9 in a mutually opposing manner. Further in the side wall 4 of main portion 2 are formed first and second grooves 12*a* and 12*b* in such a manner that their openings 13*a* and 13*b* face in opposite directions. In this embodiment the length $l_1$ between the base of the first shaft 10*a* and the free end of the second shaft 10*b* is made slightly longer than the length $l_2$ between the openings 13*a* and 13*b* of the first and second grooves 12*a* and 12*b*. In case of assembling the main and lid portions 2 and 5, at first the first shaft 10*a* is inserted into the first groove 12*a* and then the second shaft 10*b* is inserted into the second groove 12*b* by relatively moving these portions in opposite directions in turn.

Figure 12:
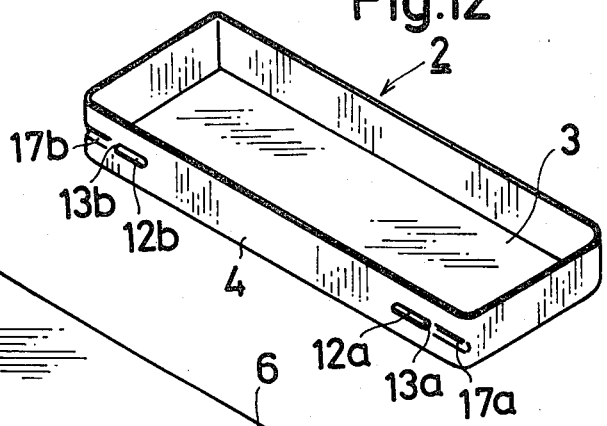
FIG. 12 is a perspective view illustrating still another embodiment of the main portion.

FIG. 12 is a perspective view illustrating still another embodiment of the main portion 2. In this embodiment in the side wall 4 of main portion 2 are formed semicircularly depressed portions 17*a* and 17*b* in order to enhance the facility of inserting operation of the shafts 10*a* and 10*b* into the grooves 12*a* and 12*b*.

Figure 13:
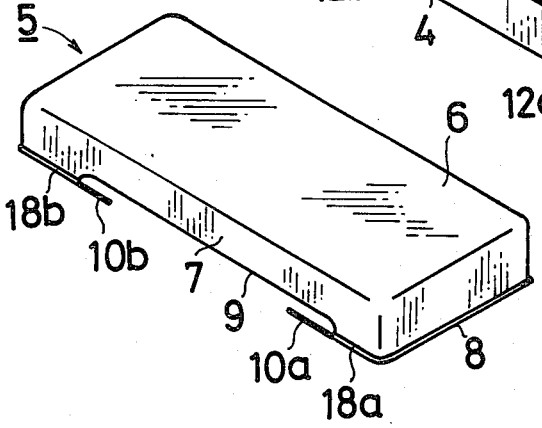
FIGS. 13 and 14 are perspective views showing still another embodiments of the lid portion of the box according to the invention.

FIG. 13 is a perspective view showing another embodiment of the lid portion 5 which can be assembled with the main portion 2 illustrated in FIGS. 10 and 12. In this embodiment the first and second shafts 10*a* and 10*b* are formed by first and second pins, respectively inserted in first and second grooves or channels 18*a* and 18*b* formed at the lower edge of the side wall 7.

Figure 14:
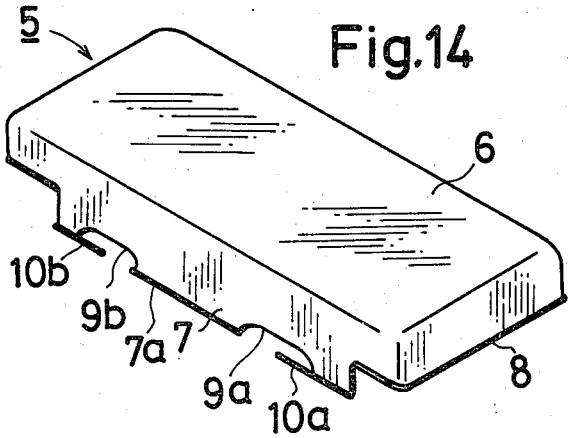

FIG. 14 is a perspective view showing still another embodiment of the lid portion 5 according to the invention, which lid portion can be coupled with the main portions 2 illustrated in FIGS. 10 and 12. In this embodiment there are formed first and second recesses 9*a* and 9*b* in the descended portion of side wall 7 of lid portion 5 and first and second shafts 10*a* and 10*b*. The shafts 10*a* and 10*b* extend toward each other and are formed integrally with the lower edge 8 of the side wall 7 of lid portion 5.

As explained above in detail in the box according to the invention the lid portion can be easily connected to the main portion from the outside of the box, so that the manufacturing process can be simple and the manufacturing cost can be materially reduced. Further the lid portion can be coupled with the main portion after the articles have been filled in the main portion, the filling operation can be effected easily and rapidly by automatic filling machines.

It should be noted that the present invention is not limited to the embodiments explained above, but may be modified in various manners within the scope of the invention. For instance, the main portion and/or lid portion may be made of synthetic resin instead of the metal plates. Further the box may be of any shape other than the rectangular shape illustrated in the drawings.

What is claimed is:

1. A box comprising a main portion having a bottom wall and a side wall;

a lid portion having a top wall and a side wall, these portions being pivotably connected to each other about an axial direction which lays in the corresponding side walls of these portions;

at least one recess formed in the side wall of lid portion and extending in said axial direction;

first and second shafts provided at a lower edge of the side wall of lid portion and extending along said recess, a length of the first shaft being longer than that of the second shaft; and first and second grooves formed in the side wall of main portion and being aligned in the axial direction, a distance between the first and second grooves being slightly different from a distance between a base of the first shaft and a top of the second shaft; whereby the first shaft is first fully inserted into the first recess by relatively moving the main and lid portions in one direction in the axial direction and then these portions are relatively moved in the other direction so as to insert the second shaft into the second groove.

2. A box according to claim 1, wherein said first and second shafts extend outwardly in mutually opposite directions and the distance between the base of first shaft and the free end of second shaft is slightly shorter than the distance between the first and second grooves.

3. A box according to claim 1, wherein said first and second shafts extend inwardly in mutually opposite directions and the distance between the base of first shaft and the free end of second shaft is slightly longer than the distance between the first and second grooves.

4. A box according to claim 1, wherein the first and second shafts are formed integrally with the side wall of the lid portion by turning over the lower edge of said side wall.

5. A box according to claim 1, wherein the first and second shafts are formed at the lower edge of that portion of the side wall of lid portion which situates between the first and second shafts.

6. A box according to claim 1, wherein said portion of the side wall of lid portion which situates between the first and second shafts is projected downward below the lower edge of the remaining portion of the side wall of lid portion.

7. A box according to claim 1, wherein the first and second shafts are formed by both end portions of a pin which is secured to the lower edge of the side wall of lid portion.

8. A box according to claim 1, wherein the first and second shafts are formed by free end portions of first and second pins, respectively secured to the lower edge of the side wall of lid portion.

9. A box according to any one of claims 7 and 8, wherein said pin is inserted into a groove formed at the lower edge of the side wall of lid portion.

10. A box according to claim 2, wherein in the side wall of main portion there is formed an elongated depression between the first and second grooves.

11. A box according to claim 10, further comprising first and second depressions aligning with the elongated depression.

12. A box according to claim 3, wherein in the side wall of main body there are formed first and second depressions extending in the axial direction outside the first and second grooves, respectively.

13. A box according to claim 1, wherein the first and second shafts are formed at the same level as the lower edge of the side wall of lid portion.

14. A box according to claim 1, wherein the lower edge of the side wall of lid portion is circularly turned over.

* * * * *